US012434939B2

(12) United States Patent
Massotte et al.

(10) Patent No.: US 12,434,939 B2
(45) Date of Patent: Oct. 7, 2025

(54) SYSTEM FOR ATTACHING THE FREE END OF A SPOOL THREAD

(71) Applicant: Superba SAS, Mulhouse (FR)

(72) Inventors: Philippe Massotte, Gueberschwihr (FR); Baptiste Tredan, Illzach (FR)

(73) Assignee: Superba SAS, Mulhouse (FR)

( * ) Notice: Subject to any disclaimer, the term of this patent is extended or adjusted under 35 U.S.C. 154(b) by 302 days.

(21) Appl. No.: 17/951,458

(22) Filed: Sep. 23, 2022

(65) Prior Publication Data

US 2023/0114121 A1 Apr. 13, 2023

(30) Foreign Application Priority Data

Sep. 30, 2021 (EP) ..... 21315193

(51) Int. Cl.
*B65H 65/00* (2006.01)

(52) U.S. Cl.
CPC ..... *B65H 65/005* (2013.01); *B65H 2701/31* (2013.01)

(58) Field of Classification Search
CPC ..... B65H 65/00; B65H 65/005; D01H 1/38; D01H 9/16
See application file for complete search history.

(56) References Cited

U.S. PATENT DOCUMENTS 3,323,189 A 6/1967 Hayashi
4,760,969 A * 8/1988 Otoshima ..... B65H 65/005 242/475.8
2002/0060455 A1* 5/2002 Thomas ..... B65H 65/005 289/2
2003/0111841 A1* 6/2003 Massotte ..... B65H 65/005 289/14

FOREIGN PATENT DOCUMENTS

JP H09240924 A 9/1997
JP 2014057422 A * 3/2014

OTHER PUBLICATIONS

European Patent Application No. 21315193.9, Search Report and Written Opinion, dated Feb. 23, 2022.

* cited by examiner

*Primary Examiner* — Anna M Momper
*Assistant Examiner* — Nathaniel L Adams
(74) *Attorney, Agent, or Firm* — Kilpatrick Townsend & Stockton LLP

(57) ABSTRACT

Disclosed is a system for fastening the free end of a thread of a spool, the system including a support means for a spool, a needle having at its end a hook associated with a mechanism for opening/closing the hook, the needle being oriented along an axis substantially parallel to the axis of the spool, a mechanism for axial pivoting and axial translation of the needle, and a retaining mechanism in position of a turn of the thread of the spool.

14 Claims, 2 Drawing Sheets

[Fig. 1]
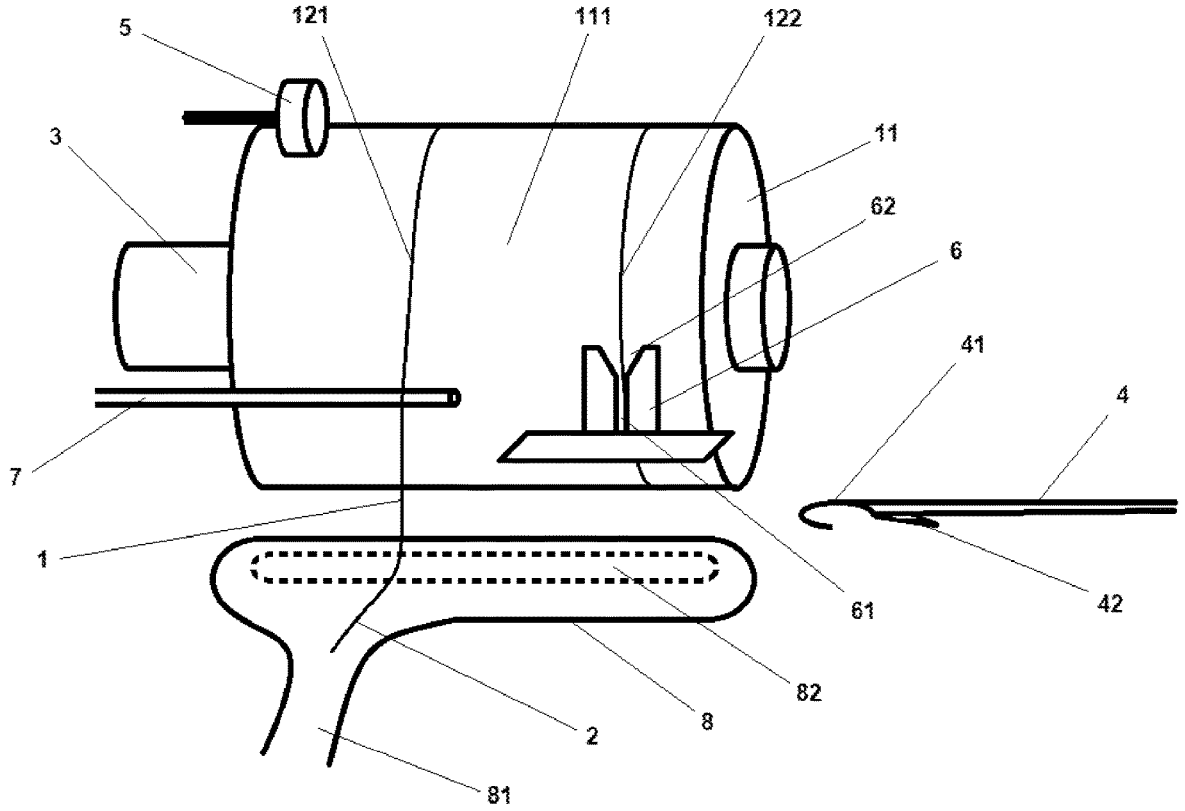
[Fig. 2]
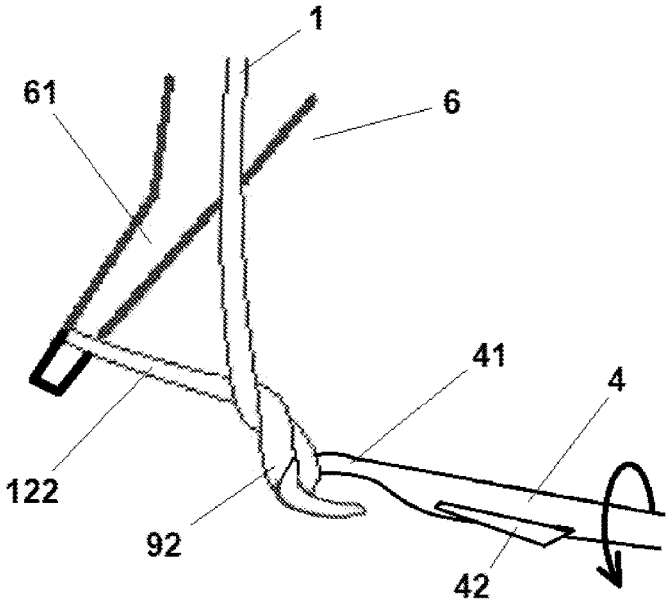

[Fig. 3]
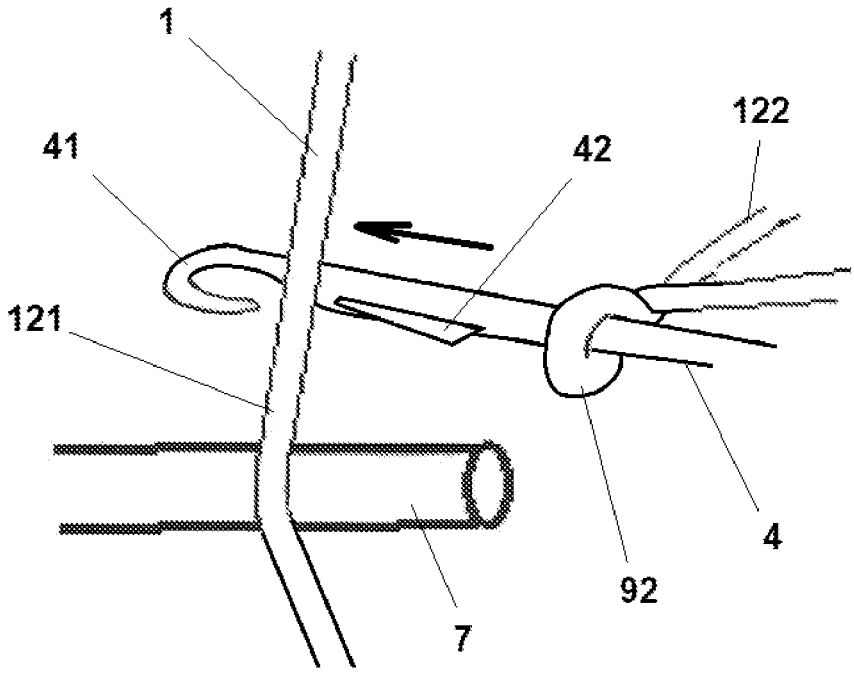
[Fig. 4]
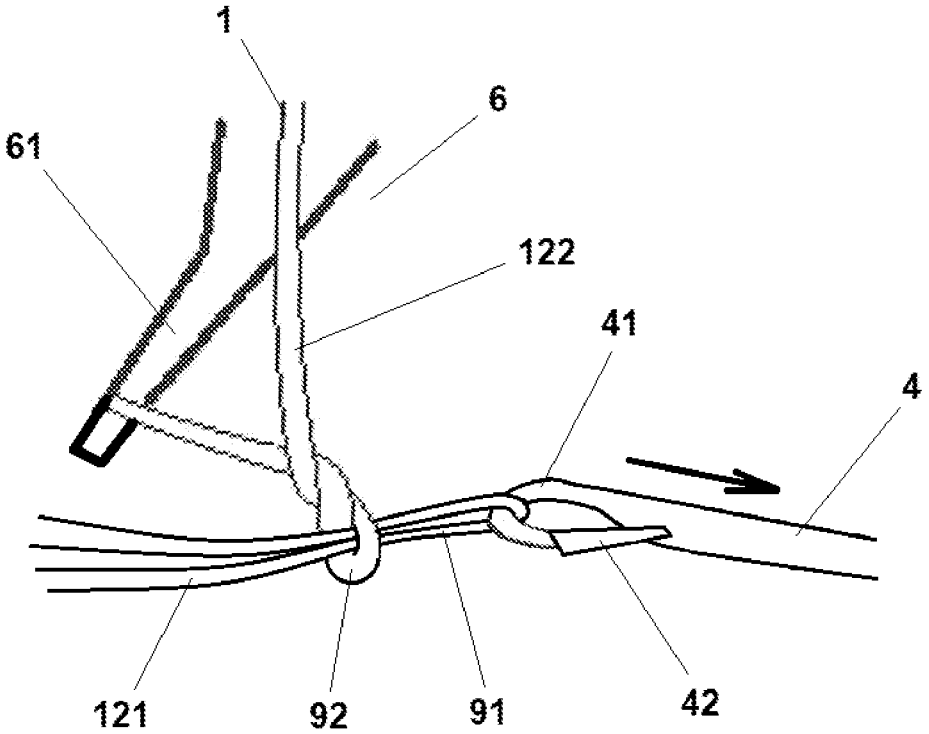

SYSTEM FOR ATTACHING THE FREE END OF A SPOOL THREAD

CROSS-REFERENCE TO RELATED APPLICATION

This application is related to and claims priority benefit of European Patent Application No. 21315193.9 filed on Sep. 30, 2021, the contents of which are incorporated herein by reference.

FIELD

The present invention relates to the field of systems for attaching the free end of a spool thread, and more particularly to the field of systems for attaching this free end without adding an additional element to the thread and to the spool.

BACKGROUND

Thread or string storage is usually realized in the form of balls or spools. In the latter, the thread is wound around a substantially straight axis over the entire length of this axis, in such a way that the spool therefore obtained adopts a substantially cylindrical form. Within the framework of an industrialization of thread production or processing, this thread is wound at the end of the operation in the form of one or several respective spools. These spools therefore create a storage format allowing a simpler management of the thread until its use at its final destination. Each of the thread spools can therefore be managed individually within the framework of handling, storage, moving, and distribution operations; these operations can be carried out either manually or with the intervention of machines that are possible automated.

However, it should be noted that when winding the thread on a spool, a first end of the thread is situated on the central axis of the spool, and the second end of the thread is positioned on the radial or peripheral surface of the spool formed. If the first end of the thread in a central position in the spool is perfectly confined by the different turns of the wound thread that covers it in the spool, such is not the case for the second end of the thread, situated on the exterior surface of the spool. Indeed, at the end of the winding process, this end of the thread is free on the surface of the spool. During these different steps of handling and moving the spool, this end of the thread is likely to detach from the rest of the spool, dragging with it at least a part of the length of the thread wound on the spool. Such a situation is particularly encountered when the texture of the thread wound on the spool is smooth and has a limited capacity to cling to the surface of the turns that make up the outside or peripheral surface of the spool. In addition, other than its detachment from the spool, such a free end is a danger for a production, processing, or management site. Indeed, when the length of this end of the thread increases, the risk that it gets sucked into a machine and causes operational issues increases. The consequences of a such a situation can quickly become dramatic.

To avoid on-site disasters related to this problem of free ends of spool thread, each of the spools is usually processed manually by an intervenor that attaches the free end of the spool by inserting it between two turns on the peripheral surface to realize a kind of slipknot. Such a knot therefore avoids a detachment of the end of the thread from the rest of the spool, while facilitating a release of this end of the thread when the spool is at its final destination for use. If this solution makes it possible to resolve the problem of the management of the free ends of thread wound on spools, it requires human intervention with manual management for each spool processed. This solution therefore creates an obvious bottleneck in a production line on an industrial scale.

To circumvent the problems generated by this solution, alternatives have been developed relying in particular on the addition of a sticker on the free end of the thread and on the peripheral surface of the spool. Alternatively, solutions relying on paper or cellophane sleeves intended to envelop the spool have also been realized. Each of these solutions has the advantage of being easily mechanizable and therefore adapted for an industrial process. However, these solutions require an additional element, whether it be a sticker or a sleeve, to maintain the free end of the thread against the peripheral surface of the spool. These solutions therefore require the contribution of an external element to each spool and its thread and lead to waste production on the site using the spool when it is at its final destination.

SUMMARY

The present invention has for purpose to alleviate these inconveniences by proposing a system making it possible to manage the free ends of the spool thread by limiting or eliminating all human intervention while making it possible to avoid the intervention of an additional element added to the spool and its thread in order to attach the free end of the thread to the spool.

Therefore, the subject matter of the invention is a system for attaching the free end of a spool thread characterized in that this system comprises:

- a support means for a spool,
- a needle comprising, at its end, a hook associated with an opening/closing mechanism of the hook, the needle being oriented according to an axis that is substantially parallel to the axis of the spool,
- an axial pivoting and axial shifting mechanism for the needle,
- a mechanism for maintaining the position of a turn of the thread of the spool.

The invention also relates to a method of implementing an attachment system according to the invention, characterized in that the method comprises:

- a hooking step, by the hook of the needle, of the turn of the thread of the spool that precedes the turn containing the free end of the thread,
- an axial pivoting step of the needle in such a way that the portion of the hooked thread creates a loop,
- an axial shifting step of the needle through said thread loop, the shift being carried out in such a way that the thread is released from the hook of the needle,
- a hooking step, by the hook of the needle, of the turn containing the free end of the thread of the spool,
- a traction step of a portion of the turn containing the free end of the thread of the spool through the thread loop realized by the portion of the turn of the thread of the spool that precedes the turn containing the free end of the thread,
- a release step of the thread hooked by the hook of the needle.

BRIEF DESCRIPTION OF THE DRAWINGS

The invention will be better understood, thanks to the following description that relates to the preferred embodiments, provided as nonlimiting examples, and explained with reference to the annexed schematic drawings, wherein:

FIG. 1 represents a schematic illustration of an example of the system for attaching the free end of a spool thread according to the invention, FIG. 2 represents a schematic illustration of an embodiment step for a loop on the portion of the thread hooked to the needle by axial pivot of the needle, FIG. 3 represents a schematic illustration of an axial shifting step of the needle through the thread loop carried out so that the needle hooks a portion of the free end of the thread of the spool, FIG. 4 represents a schematic illustration of a traction step of the portion of the free end of the thread of the spool through the thread loop previously realized to form a second thread loop.

DETAILED DESCRIPTION

The invention relates to a system for attaching the free end 2 of a spool 11 thread 1 characterized in that this system comprises:

- a support means 3 for a spool 11,
- a needle 4 comprising, at its end, a hook 41 associated with an opening/closing mechanism 42 of the hook, the needle 4 being oriented according to an axis that is substantially parallel to the spool 11 axis,
- an axial pivoting and axial shifting mechanism for the needle 4,
- a mechanism for maintaining 6 the position of a turn 122 of the thread 1 of the spool 11.

The attachment system of the invention is configured to allow an automation of the attachment of the free end 2 of the thread 1 of a spool 11 to one of the turns 122 of the thread 1 wound on the spool 11 and positioned at the peripheral surface 111 of the spool 11. This mechanized fastening of the free end 2 of the thread 1 of a spool 11 results in the realization of a loop 91 on a portion of the length of the free end 2 of the thread 1 of the spool 11, then by the insertion of this loop 91 on a turn 122 of the spool 11, in such a way that this loop 91 is pinched by a portion of the thread 1 of this turn 122 of the spool 11. The loop 91 of the free end 2 of the thread 1 is therefore attached to the turn 122 of the spool 11. Moreover, the portion of the thread 1 of the free end 2 inserted and pinched by the turn 122 of the spool 11 being in the form of a loop 91, this portion of thread 1 attached to the spool 11 is therefore easy to release in order to be retrieved during the use of the spool 11 at its final destination, by simple traction applied to the free end 2 of the thread 1 on the outside of the loop 91 inserted in a turn 122 of the spool 11.

Within the framework of the construction of the system for attachment of the invention, the support means 3 has a preferably axial arrangement, capable of being inserted into the axis of a spool 11 of the thread 1 to be processed. Indeed, traditionally, the central axes of the spools 11 are realized in the form of a hollow cylindrical element through which a support means 3 for the spool 11 can be inserted. In an alternative manner, or eventually complementary, the support means 3 has the form of a concave arrangement of a form that is substantially complementary to at least one part of the peripheral or radial surface 111 of a spool 11 whose end 2 of the thread 1 is to be managed. The support means 3 therefore realizes a housing to receive the spool 11. It should be noted that the support means 3 is likely to be associated with an orientation or movement mechanism for the position of the spool 11 within the framework of its processing by the system for attachment of the invention. Indeed, the position of the spool 11 during its reception by the system for attachment of the invention or its extraction from the system for attachment of the invention is likely to differ from the position of the spool 11 during one or several steps of operation of the system for attachment of the invention.

According to an example corresponding to a construction variant for the system for attachment of the invention, the support means 3 of the spool 11 is arranged to direct the spool 11 in a substantially horizontal manner. It should be noted that this arrangement is likely to require the intervention of a motorized directing mechanism from the spool 11 axis, once it is associated with the support means 3. Within the framework of the operation of the system of the invention, a horizontal orientation of the spool 11 has the advantage of benefiting from gravity to detach the free end 2 of the thread 1 from the surface 111 of the spool 11. The free end 2 of the thread 1 is therefore more easily handled by one or other of the elements of the system for attachment of the invention.

According to an example corresponding to a construction variant for the system for attachment of the invention and likely to be combined with the variants previously described, the support means 3 is associated with a rotational drive mechanism 5 of the spool 11. According to an example of embodiment, this rotational drive mechanism 5 has the form of a rotating roller around a substantially parallel spool 11 axis. The peripheral surface of the roller is therefore arranged to push against a part of the peripheral surface 111 of the spool 11 and make it rotate by friction. According to an alternative example of embodiment, the rotational drive mechanism 5 is realized by means of a motor that performs an axial rotation of the support means 3 when this support means 3 is in the form of a straight axial structure arranged to be inserted into the central axis of the spool 11 and fastened in rotation with the spool 11. Within the framework of the operation of the system for attachment of the invention, the rotational drive mechanism 5 of the spool 11 makes it possible to control the unwinding and winding of the thread 1 in relation to the spool 11, particularly on the free end 2. The rotational driving mechanism 5 also makes it possible to retighten the thread 1 in the spool 11 at the different turns 122 of the spool 11, in particular by jointly operating, on the one hand, a fixed holding of the free end 2 of the thread 1 and, on the other hand, a rotation of the spool 11 in the direction of a winding of the thread 1. The rotation of the spool 11 in the direction of a winding of the thread 1 will, in particular, make it possible to perform a traction on this thread 1 at the level of the turns that surround the spool 11. When the rotational driving mechanism 5 involves a motorization that carries out the axial rotation of the support means 3, the traction on the thread 1 is applied from the end of the thread 1 situated at the central axis of the spool 11.

According to an example of construction for the system for attachment of the invention, the needle 4 comprising a hook 41 at its end is of the type of those used within the framework of a knitting machine. The orientation of the needle 4 according to an axis that is substantially parallel to the spool 11 axis makes it possible to perform an insertion of the needle 4 between the free end 2 of the thread 1 and the rest of the surface 111 of the spool 11. This insertion is particularly achievable by positioning the needle 4 facing the peripheral surface 111 of the spool 11, then when the free end 2 of the thread 1 is separated from the rest of the surface 111 of the spool 11, by moving the needle 4 around the spool 11 in an identical direction to that of the winding of the thread 1 around the spool 11. The needle 4 is made to come into contact with the thread 1 at a portion of its free end 2, then to be moved around the spool 11, between the thread 1 and the surface 111 of the spool 11. The hook 41 found on the end of the needle 4 is configured to hook a portion of the thread 1 pushing against the surface of the needle 4 when the needle axially shifts away from the spool 11. The hook 41 is also configured to catch a portion of the thread 1 pushing against the surface of the needle 4 opposite to the surface of the needle 4 facing the surface 111 of the spool 11. In addition, in a preferential manner, the hook 41 is also configured to allow the portion of thread 1 positioned inside of the hook 41 to be released from the hook 41 in the direction of the part of the needle 4 situated on the opposite side of the end of the needle 4 that contains the hook 41. Therefore, the hook 41 has a form configured in such a way that, on the one hand, when the needle 4 shifts in traction, a portion of thread 1 positioned on the inside of the hook 41 remains hooked to the moving needle 4 and that, on the other hand, when the needle 4 shifts in the opposite direction, a portion of thread 1 positioned inside the hook 41 is likely to slide from the inside of the hook 41 in direction of the surface of the needle positioned on the opposite side of the end of the needle 4 that contains the hook 41. As an example, the hook 41 found on the end of the needle 4 is placed with an orifice positioned on the lateral surface of the needle 4. This orifice has a first edge positioned on the side of the end of the needle 4 and a second edge positioned on the opposite side on the body of the needle 4. The first edge of the orifice is realized by the junction between the concavity of the inside of the hook 41 and the convexity of the end of the needle 4. The second edge of the orifice is realized by the junction between the inside of the hook 41 and the lateral surface of the body of the needle 4. In order to facilitate the sliding of a portion of thread 1 between the inside of the hook 41 and the surface of the body of the needle 4, this junction is arranged to have a surface with little or no raised areas or asperities. This junction is also likely to have a surface continuity between, on the one hand, the inside of the hook 41, and on the other hand, the surface of the body of the needle 4.

The hook 41 found on the end of the needle 4 is associated with an opening/closing mechanism 42 for the hook 41. This mechanism 42 makes it possible for the thread to slide against the surface of the needle 4 at the hook 41 without this thread being caught by the hook 41 of the needle 4. When the opening/closing mechanism 42 is in the closed position, the hook 41 has the form of a closed loop positioned at the end of the needle 4. In a preferential manner, the needle 4 has a surface continuity at the portion of the needle 4 that contains the hook 41 to facilitate the thread's sliding against the surface of the needle 4. Conversely, when the opening/closing mechanism 42 is in the open position, the hook 41 is released and is capable of hooking a thread that is sliding against the surface of the needle 4. According to a particular example of construction of this opening/closing mechanism 42 of the hook 41, this mechanism is associated with a motorized actuator, possibly combined with an interface to control the open/closed position of the hook 41.

According to an example corresponding to a construction variant for the system for attachment of the invention, the opening/closing mechanism 42 of the hook 41 of the needle 4 is realized by a mounted clap hook 42 pivoting around an axis that is substantially perpendicular to the axis of the needle 4. In a preferred manner, the pivoting axis of the clap hook 42 is positioned on the side of the orifice of the hook 41 opposite to the end of the needle 4. Also, in a preferred manner, the movement of the clap hook 42 is carried out in the form of a swivel radius outside the hook 41. According to a particular example of construction, this clap hook 42 is in a free-motion position in relation to the needle 4 and comprises, at one of its surfaces situated on the level of the surface of the needle 4, a raised area with respect to the surface of the needle 4, this raised area being able to interact with a thread moving against the surface of the needle 4. Therefore, the movement of a thread 1 against the surface of the needle 4 is caught by a raised area of the clap hook 42 and causes the pivoting of this clap hook 42 and therefore the opening or closing of the hook 41 of the needle 4. According to a preferred construction of this clap hook 42, the movement relating to a portion of thread 1 positioned inside of the hook 41 in relation to the needle 4 that is shifting is likely to provoke the opening of the clap hook 42 by the simple force exerted by the portion of the thread 1 against the interior surface of the clap hook 42. This situation is particularly likely to occur when, for example, a portion of thread 1 has a loose tension inside of the hook 41 and that the needle 4 is shifted axially in the opposite direction to the traction of thread 1.

According to an example corresponding to a construction variant for the system for attachment of the invention forming an alternative to the variant previously described, the opening/closing mechanism 42 of the hook 41 of the needle 4 is realized by a shaft sliding according to the axis of the needle 4 in order to stop against the junction between the concavity of the inside of the hook 41 and the convexity of the end of the needle 4. Such a construction of the opening/closing mechanism 42 of the hook 41 is similar to that of a bolt snap. According to this example of construction, the sliding shaft is positioned to have, on its outside surface, an optimized surface continuity with the outside surface of the hook 41 and the surface of the needle 4 in such a way that a thread can slide without difficulty on the surface of the sliding shaft when this thread moves on the hook 41 along the length of the needle 4.

Within the framework of the system for attachment of the invention, the retaining mechanism 6 in the position of a turn 122 of the thread 1 of the spool 11 is an arrangement that makes it possible to prevent movement along the surface 111 of the spool 11 of a portion of thread 1 separated from the peripheral surface 111 of the spool 11, in particular when this portion of thread 1 is not under tension. According to an example of construction of the retaining mechanism 6, it comprises at least one substantially flattened structure placed to be positioned between, on the one hand, the axis of the needle 4, positioned at a distance from the spool 11, and on the other hand, the surface 111 of the spool 11. This retaining mechanism 6 is preferentially associated with the means of motion in order to make its positioning possible between, on the one hand, the needle 4, and on the other hand, the surface 111 of the spool 11, once the needle 4 has caught a turn 122 of the thread 1 of the spool 11. The structure of the retaining mechanism 6 has a slot 61 that is open on one of its edges. This slot 61 has a sufficient width in order to be passed through by a portion of thread 1 of the spool 11. According to an example of construction having an preferred arrangement of the structure of the retaining mechanism 6, the slot 61 has a form substantially corresponding to the letter "V," at least at the opening 62 of the slot 61 on the edge of the structure of the retaining mechanism 6, in such a way that this opening 62 of the slot 61 has a width greater than the width of the rest of the slot 61. According to an example of embodiment of the retaining mechanism 6 in the system of the invention, this retaining mechanism 6 is positioned in relation to the spool 11, in such a way that the plane of the turn 122 of the spool 11, of which a portion of the thread 1 is intended to be held in position, is positioned through the slot 61 of the arrangement in the "V" form of the structure of the retaining mechanism 6. The plane of the turn 122 of the spool 11, of which a portion of the thread is intended to be held in position, corresponds substantially to a plane perpendicular to the spool 11 axis. During the movement of the flattened structure of the retaining mechanism 6 between, on the one hand, the needle 4 having caught a portion of the thread 1 of a turn 122 of the spool 11 to position it at a distance from the surface 111 of the spool 11, and on the other hand, the surface 111 of the spool 11, the "V" form arrangement acts as a guide to insert and position the portion of the thread 1 in the slot 61 of the retaining mechanism 6. The slot 61 of the retaining mechanism 6 therefore makes it possible to limit the range of motion, or eliminate the movement of the portion of thread 1 positioned through the slot 61 of the retaining mechanism 6 when the needle 4 carries out certain movements of axial shifting.

According to an example corresponding to another construction variant for the system for attachment of the invention and likely to be combined with the variants previously described, the system comprises a positioning mechanism for the needle 4 between, on the one hand, a portion of the turn 122 of the thread 1 of the spool 11 that precedes the turn 121 containing the free end 2 of the thread 1, and on the other hand, the rest of the spool 11 of thread 1. This positioning mechanism is configured to divert the free end 2 of the thread 1 in relation to the spool 11 to make it possible to insert a part of the needle 4 between the free end 2 of the thread 1 and the spool 11. The needle 4, positioned between the free end 2 of the thread 1 and the surface 111 of the spool 11, by movement around the spool 11 axis, moves from a first position between the surface of the spool 11 and the turn 121 of the thread 1 that contains the free end 2 towards a second position between the surface of the spool 11 and the turn 122 of the thread 1 of the spool 11 that precedes the turn 121 containing the free end 2 of the thread 1. The movement of the needle 4 around the spool 11 axis is likely to be carried out by pivoting the needle 4 around the spool 11 axis, or by a succession of different shifts around the spool 11 axis.

According to an example corresponding to another construction variant for the system for attachment of the invention and likely to be combined with the variants previously described, the system comprises a positioning mechanism 7 of at least one portion of the turn 121 that contains the free end 2 of the thread 1 of the spool 11 at the shifting axis of the needle 4. This positioning mechanism 7 of a portion of the turn 121 that contains the free end 2 of the thread 1 is configured to carry out an adjustment of the position of the free end 2 of the thread 1 in relation to the surface 111 of the spool 11. This adjustment mechanism 7 for the position of a portion of the turn 121 that contains the free end 2 of the thread 1 of the spool 11, meaning the portion of the thread 1 situated between, on the one hand, the free end 2, and on the other hand, the surface 111 of the spool 11, is also likely to be integrated into the positioning mechanism of the needle 4 between, on the one hand, a portion of the turn 122 of the thread 1 of the spool 11 that precedes the turn 121 containing the free end 2 of the thread 1, and on the other hand, the rest of the spool 11 of thread 1. This positioning mechanism 7 of at least one portion of the turn 121 that contains the free end 2 of the thread 1 is configured to carry out a distancing of the free end 2 of the thread 1 in relation to the surface 111 of the spool 11. According to an example corresponding to a construction variant for this positioning mechanism 7, it is embodied by an element of which the structure comprises an axial portion oriented to be substantially parallel with the spool 11 axis of thread 1. This element is configured to be in contact with a portion of the free end 2 of the thread 1, while being movable in a plane perpendicular to the spool 11 axis, in such a way that the turn 121 that contains the free end 2 of the thread 1, meaning the portion of the thread 1 situated between, on the one hand, the free end 2, and on the other hand, the surface 111 of the spool 11, is moved without the spool 11 being moved. Moving this portion of the thread 1 situated between the free end 2 and the surface 111 of the spool 11 makes it possible to adjust its position in relation to the axis of needle 4. Also, moving this portion of the thread 1 allows, on the one hand, its distancing from the surface 111 of the spool 11, and on the other hand, an adjustment of the position of this portion of thread 1 in such a way that it is aligned to the axial shifting axis of the needle 4. This alignment also allows the needle 4 that is shifting to come into contact with the portion of the thread 1 situated between, on the one hand, the free end 2, and on the other hand, the surface 111 of the spool 11, meaning the portion of the turn 121 containing the free end 2 of the thread 1, in order to catch this portion of the turn 121 with the hook 41 and to pull it by shifting the needle 4.

According to an example corresponding to another construction variant for the system for attachment of the invention and likely to be combined with the variants previously described, the system comprises a positioning mechanism 8 of the free end 2 of the thread 1 of the spool 11 in an off-centered manner in relation to the turn 122 of the thread 1 of the spool 11 that precedes the turn 121 containing the free end 2 of the thread 1. The shift realized by this positioning mechanism 8 is applied to the length of the surface 111 of the spool 11 according to the spool 11 axis. This shift is realized by moving the free end 2 of the thread 1 of the spool 11 according to a shift along an axis that is substantially parallel to the spool 11 axis. In a preferential manner, this shift of the free end 2 of the thread 1 is carried out according to a distancing of the free end 2 of the thread 1 in relation to the position of the end of the needle 4 along the surface 111 of the spool 11. This shift therefore makes it possible to prevent a portion of the thread 1 from the turn 121 containing the free end 2 of the thread 1 from overlapping the turn 122 of the thread 1 of the spool 11 that precedes the turn 121 containing the free end 2 of the thread 1. Indeed, such an overlapping of the two turns, 121, 122 would be likely to alter the capacity of the needle 4 to insert correctly between the surface 111 of the spool 11 and the turn 122 of the thread 1 that precedes the turn 121 containing the free end 2 of the thread 1, without the needle 4 positioning itself between the surface 111 of the spool 11 and the turn 121 containing the free end 2 of the thread 1. In this way, the positioning mechanism 8 of the free end 2 of the thread 1 of the spool 11 in an off-centered manner makes it possible for the needle 4 to only be inserted between, on the one hand, the surface 111 of the spool 11, and on the other hand, the turn 122 of the thread 1 that precedes the turn 121 containing the free end 2 of the thread 1. According to an example of construction, the positioning mechanism 8 of the free end 2 of the thread 1 of the spool 11 is likely to require the intervention of a vacuuming means 81 associated with a nozzle 82 whose opening is substantially lengthened and oriented according to an axis substantially horizontal and/or parallel to the spool 11 axis. In a preferred manner, the opening of the nozzle 82 is positioned in a plane, on the one hand, substantially vertical, and on the other hand, positioned in a substantially tangential manner to the surface 111 of the spool 11. A construction of the positioning mechanism 8 of the free end 2 of the thread 1 according to this example allows the mechanism to recuperate the free end 2 of the thread 1 that is hanging on one side of the spool 11, whatever its position along the surface 111 of the spool 11. In a preferred manner, the vacuum means 81 is positioned at one end of the nozzle 82 to move the free end 2 of the thread 1 towards this vacuum means 81. According to another example of construction, the positioning mechanism 8 of the free end 2 of the thread 1 of the spool 11 is likely to require the intervention of a pinching interface for the free end 2 of the thread 1, for example in the form of a pair of counter-rotating rollers positioned according to an axis substantially horizontal and/or parallel to the spool 11 axis, the junction area of the two rollers being positioned in a plane, on the one hand, substantially vertical, and on the other hand, positioned in a substantially tangential manner to the surface 111 of the spool 11. This pinching interface is also associated with a shifting means of this pinching interface to allow the movement of the free end 2 of the thread 1 of the spool 11, pinched according to a gap in relation to the position of the end of the needle 4 along the surface 111 of the spool 11.

According to an example corresponding to a construction variant for the system for attachment of the invention and likely to be combined with the variants previously described, the system comprises a tensioning mechanism for the free end 2 of the thread 1 of the spool 11. This tensioning mechanism is configured to manage the tension or loosening of the thread 1, particularly in relation to the spool 2, particularly on a portion of the thread 1 corresponding to its free end 2 and the first turns of the thread 1 starting from this free end 2 around the spool 11. This tensioning mechanism is likely to also be realized by at least one part of the positioning mechanism 8 of the free end 2 of the thread 1 of the spool 11 previously described, namely, for example, a vacuum means 81 or a pair of counter-rotating rollers.

According to an example corresponding to another construction variant for the system for attachment of the invention and likely to be combined with the variants previously described, the support means 3 of the spool 11 is mounted on a structure that is independent of the other constituent elements of the system for attachment of the invention. Such a construction variant makes it possible to assemble the different elements that make up the system for attachment of the invention on a spool 11 already positioned on an existing support means 3. The system of the invention is therefore likely to be assembled several times successively on different spools on respective support means 3. The independent structure/structures of the support means 3 of the spool 11 that bear/bears one or several of the elements of the system of the invention therefore make/makes it possible to benefit from the support means 3 of the spool 11 already used at one or more other points of a thread 1 production chain when the spools 11 are moved between points in the industrial chain while remaining placed on their respective support means 3. It should be noted that, according to its mode of construction, the rotational drive mechanism 5 of the spool 11 is likely to be found on the same structure as the one that bears the support means 3 of the spool 11, or alternatively, by another independent structure.

The invention also relates to a method of implementing an attachment system according to the invention, characterized in that the method comprises:

a hooking step, by the hook 41 of the needle 4, of the turn 122 of the thread 1 of the spool 11 that precedes the turn 121 containing the free end 2 of the thread 1, an axial pivoting step of the needle 4 in such a way that the portion of the hooked thread 1 creates a loop 92, an axial shifting step of the needle 4 through the loop 92 of thread 1 thus realized, the shift being carried out in such a way that the thread 1 is released from the hook 41 of the needle 4, a hooking step, by the hook 41 of the needle 4, of the turn 121 containing the free end 2 of the thread 1 of the spool 11, a traction step of a portion of the turn 121 containing the free end 2 of the thread 1 of the spool 11 through the loop 92 of thread 1 realized by the portion of the turn 122 of the thread 1 of the spool 11 that precedes the turn 121 containing the free end 2 of the thread 1, a release step of the thread 1 caught by the hook 41 of the needle 4.

According to a particular example of implementation of the method of the invention, the step of axial pivoting of the needle 4 is carried out by an axial rotation of the needle 4 of at least one complete turn for making a loop 92 from the portion of the thread 1 hooked to the needle 4. During this axial pivoting step, the portion of thread 1 of the turn 122 of the spool 11 hooked to the needle 4 is held in tension inside hook 41 of needle 4.

According to a particular example corresponding to a variant implementation of the method of the invention that can be combined with the previously detailed variants, together with the step of axial translation of the needle 4, the method comprises a step of retaining in position the portion of the turn 122 forming the loop 92 of the thread 1 made so that the needle 4 translates easily through the loop 92 of thread 1. This step of retaining the portion of thread 1 of the turn 122 of the spool 11 which makes the loop 92 of thread 1 around the axis of the needle 4 is carried out thanks to a retaining mechanism 6 in position arranged to block any movement over the length of the surface 111 of the spool 11 of the thread portion 1 of the turn 122 which forms the loop 92. According to a preferred implementation variant, the tension exerted on the thread portion 1 of the turn 122 which forms the loop 92 is released so as to facilitate the release of the loop 92 from thread 1 of the hook 41 of the needle 4 and the axial translation of needle 4 through this loop 91 of thread 1.

According to a particular example corresponding to another implementation variant of the method of the invention that can be combined with the previously detailed variants, the step of pulling a portion of the turn 121 bearing the free end 2 of thread 1 of spool 11 through loop 92 of thread 1 made by the portion of turn 122 of thread 1 of spool 11 which precedes turn 121 bearing the free end 2 of thread 1 is made over a length sufficient to allow making a loop 91 of thread 1 through the loop 92 of thread 1 previously formed. However, this pulling step is stopped before the free end 2 of thread 1 passes through this loop 92 of thread 1 previously formed, so that the portion of thread 1, positioned at the free end 2 of the thread 1, makes a slip knot through the loop 92 of thread 1 previously formed. Furthermore, according to an example of a preferred implementation of the method of the invention, it should be noted that, during this pulling step, the tension at the free end 2 of thread 1 of spool 11 is released so as to facilitate the pulling of the thread 1 through this previously formed loop 92 of thread 1, while being monitored so as to prevent the portion of thread 1 hooked to the needle 4 from detaching therefrom.

According to a particular example corresponding to another implementation variant of the method of the invention that can be combined with the previously detailed variants, prior to the step of releasing the thread 1 hooked by the needle 4, the method comprises a step of tightening the loop 92 formed by the turn 122 of the spool thread which precedes the turn 121 bearing the free end 2 of the thread 1, around the portion of the turn 121 bearing the free end 2 of the thread 1 positioned through this loop 92. The tightening of the loop 92 is likely to be carried out by pulling the thread 1 at each of the portions of thread 1 located on either side of the loop 92. It should be noted that no traction should be performed on the thread 1 at a length positioned between the free end 2 of the thread 1 and the portion of the thread 1 positioned through this loop 92 formed by the turn 122 of the spool thread which precedes the turn 121 bearing the free end 2 of the thread 1, so as not to detach the free end 2 of the thread from the turn 122 at which it is inserted.

According to an example corresponding to a specific variant of the implementation variant of the method of the invention detailed above, the step of tightening the loop 92 is operated by pulling at a portion of the thread 1 positioned upstream of the loop 92 through which the portion of the turn 121 bears the free end 2 of the thread 1 that the hook 41 of the needle 4 holds. As an example of implementation, this step of tightening the loop 92 is carried out by pulling at the portion of thread 1 positioned on the side opposite to the free end 2 of thread 1 with respect to the position of loop 122. This tightening of loop 92 formed by turn 122 of the spool thread which precedes the turn 121 bearing the free end 2 of the thread 1 makes it possible to improve the holding of the loop 91 formed by the turn 121 bearing the free end 2 of the thread 1 attached to the spool 11, while remaining easily detachable.

According to a particular example corresponding to another implementation variant of the method of the invention that can be combined with the previously detailed variants, prior to the step of pulling a portion of the turn 121 bearing the free end 2 of the thread 1 of the spool 11 through the thread loop 92 made by the portion of the turn 122 of the thread 1 of the spool 11 which precedes the turn 121 bearing the free end 2 of the thread 1, the method comprises a step of closing the hook 41 of the needle 4 having hooked the turn 121 bearing the free end 2 of the thread 1 of the spool 11. This closing of the hook 41 of the needle 4 allows the thread portion 1, which forms the loop 92 formed by the turn 122 of the spool thread which precedes the turn 121 bearing the free end 2 of the thread 1, to slide against the surface of the needle 4 and, in particular, at the part of the needle 4 which makes the hook 41 without this portion of the thread 1 being caught by the hook 41 of the needle 4. According to an exemplary implementation of this step of the method, the mechanism 42 for opening/closing the hook 41 involves a mechanism 42 comprising a relief projecting with respect to the surface of the needle 4 when this clap hook 42 is in the open position of the hook 41 of the needle 4. During the step of pulling the portion of turn 121 bearing the free end 2 of the thread 1 by the hook 41 of the needle 4, the thread 1 of the loop 92, through which the needle 4 runs, slides against the surface of needle 4 in the direction of the hook 41. Before reaching the hook 41 and when getting close to it, the thread 1 of the loop 92 comes into contact with the relief of the clap hook 42 and interacts with the latter to push the clap hook 42 and cause it to pivot into the closed position of the hook 41, so that, upon reaching the hook 41 of the needle 4, the thread 1 of the loop 92 slides against the surface of the clap hook 42 which closes the orifice of the hook 41.

According to a particular example corresponding to another implementation variant of the method of the invention that can be combined with the previously detailed variants, the method comprises beforehand a step of offsetting the free end 2 of the thread 1 of spool 11 with respect to the position of turn 122 of thread 1 of spool 11 which precedes turn 122 bearing the free end 2 of the thread 1. Thus, prior to the various steps set out above, the free end 2 of the thread 1 of the spool 11 is moved in translation along an axis substantially parallel to the axis of the spool 11. Preferably, this offsetting of the free end 2 of the thread 1 is carried out according to a spacing of the free end 2 of the thread 1 with respect to the position of the end of the needle 4 along the surface 111 of the spool 11. Thus, this offsetting makes it possible to prevent a portion of the thread 1 from the turn 121 bearing the free end 2 of thread 1 from being superimposed on the turn 122 of thread 1 of spool 11 which precedes turn 121 bearing the free end 2 of the thread 1. Thus, needle 4 is able to fit correctly between surface 111 of spool 11 and turn 122 of the thread 1 which precedes the turn 121 bearing the free end 2 of the thread 1, without the needle 4 being positioned between the surface 111 of the spool 11 and the turn 121 bearing the free end 2 of the thread 1.

Obviously, the invention is not limited to the embodiments described and shown in the accompanying drawings. Modifications remain possible, in particular from the point of view of the constitution of the various elements, or by substitution of technical equivalents, without thereby departing from the scope of protection of the invention.

That which is claimed is:

1. A method for implementing a system for fastening a free end of a spool of thread, wherein the system comprises:

a support means for the spool;

a needle comprising at an end of the needle: a hook and a mechanism for opening/closing the hook, the needle being oriented along an axis substantially parallel to the axis of the spool, wherein the needle is axially pivotable and axially translatable; and retaining mechanism in position of a turn of the thread of the spool;

wherein the method comprises:

a hooking step, by the hook of the needle, of a turn of the thread of the spool, which precedes a turn bearing the free end of the thread;

a step of axial pivoting of the needle so that a hooked portion of the thread forms a loop;

a step of axial translation of the needle through the loop of thread made, the translation being carried out so that the thread is released from the hook of the needle;

a hooking step, by the hook of the needle, of the turn bearing the free end of the thread of the spool;

a pulling step of a portion of the turn bearing the free end of the thread of the spool through the loop of thread made by the portion of the turn of the thread of the spool which precedes the turn bearing the free end of the thread; and a releasing step of the thread hooked by the hook of the needle.

2. The method according to claim 1, wherein the mechanism for opening/closing the hook of the needle comprises a clap hook mounted pivoting around an axis substantially perpendicular to the axis of the needle.

3. The method according to claim 1, wherein the mechanism for opening/closing the hook of the needle comprises a rod sliding along the axis of the needle to abut against a junction between a concavity of an inside of the hook and a convexity of the end of the needle.

4. The method according to claim 1, wherein the needle is positionable between a portion of the turn of the thread of the spool, which precedes a turn bearing the free end of the thread and the rest of the spool of thread.

5. The method according to claim 1, wherein the system comprises a mechanism for tensioning the free end of the thread of the spool.

6. The method according to claim 1, wherein the system comprises a mechanism for positioning the free end of the thread of the spool in an offset manner relative to the turn of the thread of the spool, which precedes a turn bearing the free end of the thread.

7. The method according to claim 1, wherein the system comprises a mechanism for positioning at least a portion of the turn of the thread of the spool, which bears the free end of the thread of the spool, at the axis of the needle.

8. The method according to claim 1, wherein the support means of the spool is arranged to orient the spool in a substantially horizontal manner.

9. The method according to claim 1, wherein the support means for the spool is mounted on a structure independent of the other constituent elements of the system.

10. The method according to claim 1, wherein, prior to the step of releasing the thread hooked by the needle, the method comprises a step of tightening the loop formed by the turn of the spool thread which precedes the turn bearing the free end of the thread, around the portion of the turn bearing the free end of the thread positioned through this loop.

11. The method according to claim 10, wherein the step of tightening the loop is performed by pulling at a portion of the thread positioned upstream of the loop crossed by the portion of the turn bearing the free end of the thread that retains the hook of the needle.

12. The method according to claim 1, wherein, together with the step of axial translation of the needle, the method comprises a step of retaining in position the portion of the turn forming the loop of thread made so that the needle translates through the loop of thread.

13. The method according to claim 1, wherein, prior to the step of pulling a portion of the turn bearing the free end of the thread of the spool through the loop of thread formed by the portion of the turn of the thread of the spool which precedes the turn bearing the free end of the thread, the method comprises a step of closing the hook of the needle having hooked the turn bearing the free end of the thread of the spool.

14. The method according to claim 1, wherein the method comprises beforehand a step of spacing the free end of the thread of the spool with respect to the position of the turn of the thread of the spool which precedes the turn bearing the free end of the thread.

* * * * *